US005724061A

United States Patent [19]

Kanbara

[11] Patent Number: 5,724,061

[45] Date of Patent: Mar. 3, 1998

[54] DISPLAY DRIVING APPARATUS FOR PRESENTING SAME DISPLAY ON A PLURALITY OF SCAN LINES

[75] Inventor: Minoru Kanbara, Hachioji, Japan

[73] Assignee: Casio Computer Co., Ltd., Tokyo, Japan

[21] Appl. No.: 361,979

[22] Filed: Dec. 22, 1994

[30] Foreign Application Priority Data

Dec. 29, 1993 [JP] Japan ..... 5-353901

[51] Int. Cl.[6] ..... G09G 3/36

[52] U.S. Cl. ..... 345/100; 345/98; 345/55

[58] Field of Search ..... 345/100, 79, 88, 345/90, 92, 208, 202, 197, 98, 203, 55

[56] References Cited

U.S. PATENT DOCUMENTS

| | | | |
|---|---|---|---|
| 4,716,403 | 12/1987 | Moriozumi | 345/100 |
| 4,724,433 | 2/1988 | Inoue et al. | 345/208 |
| 4,825,203 | 4/1989 | Takeda et al. | 345/100 |
| 4,890,101 | 12/1989 | Carlson | 345/100 |
| 4,922,240 | 5/1990 | Duwaer | 345/100 |
| 5,103,218 | 4/1992 | Takeda | 345/100 |
| 5,162,786 | 11/1992 | Fukuda | 345/100 |
| 5,192,945 | 3/1993 | Kusada | 345/100 |
| 5,206,631 | 4/1993 | Yamamoto et al. | 345/79 |
| 5,250,931 | 10/1993 | Misawa et al. | 345/92 |
| 5,497,434 | 3/1996 | Wilson | 345/202 |
| 5,574,483 | 11/1996 | Nishizawa | 345/203 |

FOREIGN PATENT DOCUMENTS 2262377 6/1993 United Kingdom .

OTHER PUBLICATIONS

Patent Abstracts of Japan, vol. 16, No. 430 (P-1417), Sep. 9, 1992 & JP-A-04 147212 (Toshiba Corp), May 20, 1992.

*Primary Examiner*—Mark R. Powell
*Assistant Examiner*—John Suraci
*Attorney, Agent, or Firm*—Frishauf, Holtz, Goodman, Langer & Chick

[57] ABSTRACT

A display driving apparatus includes a matrix display device for displaying an image. The matrix display device has switching elements and data written elements connected to the switching elements. The switching elements and the data written elements are arranged in rows and columns to form a matrix. A plurality of scan lines are arranged in a predetermined number of rows, with each row of the plurality of scan lines being connected to respective ones of the switching elements arranged along a corresponding row of the matrix. A plurality of data lines are connected to the switching elements for supplying lines of display data to be displayed on successive rows of the scan lines, and a data line driver circuit is connected to the switching elements via the data lines for supplying the switching elements connected to successive rows of the scan lines with the lines of display data. The data line driver circuit includes a shift register for receiving and shifting lines of display data supplied in serial thereto, and a latch circuit. The latch circuit successively receives lines of display data from the shift register, holds a previous line of received display data, and supplies the held previous line of display data to the switching elements connected to a successive row of the scan lines when the latch circuit does not receive a successive new line of display data from the shift register. A controller inhibits the shift register from receiving lines of display data corresponding to a predetermined number of successive rows of the scan lines.

20 Claims, 5 Drawing Sheets

DISPLAY DRIVING APPARATUS FOR PRESENTING SAME DISPLAY ON A PLURALITY OF SCAN LINES

BACKGROUND OF THE INVENTION

1. Field of the Invention

The present invention relates to an active matrix liquid crystal display driving apparatus for use in a liquid crystal television, a liquid crystal projector and so forth, and, more particularly, to a display driving apparatus which presents the same display on a plurality of scan lines.

2. Description of the Related Art

In an active matrix display system, a non-linear active element is placed at each pixel to eliminate the interference of other signals, thereby achieving high image quality.

Conventionally, a display driving apparatus, particularly, a display driving apparatus using a liquid crystal display (LCD) panel has switching elements 3 and pixel capacitors 4 arranged in a matrix form at the intersections of data lines $DL_1$ to $DL_M$ and scan lines $G_1$ to $G_N$, laid out respectively in M columns and N rows, as shown in FIG. 3 showing the circuit structure of an active matrix LCD panel driver section. Only one set of the switching element 3 and pixel capacitor 4 is illustrated in FIG. 3. The individual scan lines $G_1$–$G_N$ are connected to a scanning shift register 6 via a driver circuit 5 and the individual data lines $DL_1$–$DL_M$ are connected to a data shift register 9 via a driver circuit 7 and a latch circuit 8.

In this active matrix display system, pixel electrodes constituting the pixel capacitors 4 and the switching elements, for example, TFTs (Thin Film Transistors), connected to the pixel capacitors 4, are arranged on the inner face of one electrode substrate. The switching elements 3 are driven in a matrix form so that the pixel capacitors 4 are charged via the associated switching elements 3. The driver circuit 5 and the scanning shift register 6 constitute a gate driver 10, while the driver circuit 7, the latch circuit 8 and the data shift register 9 constitute a drain driver 11.

A vertical sync signal $\phi V$ and a vertical clock signal $C_{PV}$, which becomes a data transfer clock, are input to the shift register 6. The scanning shift register 6 sequentially outputs scan signals to the individual scan lines $G_1$–$G_N$ via the driver circuit 5. The scan signals sequentially reach a high level in one horizontal scan period (63.5 μs) or 1H period to turn on the switching elements 3 connected to the associated scan lines $G_1$–$G_N$, so that the pixels connected to the associated scan lines $G_1$–$G_N$ are selectively driven one by one.

A data transfer clock (horizontal clock signal) $C_{PH}$ and data DATA are input to the shift register 9. The data shift register 9 shifts the data DATA in response to the data transfer clock $C_{PH}$ and outputs the shifted data to the latch circuit 8.

The latch circuit 8 latches the output from the data shift register 9 in response to a latch signal LP.

The driver circuit 7 amplifies display data, latched in the latch circuit 8, supplies the amplified data to the data lines $DL_1$–$DL_M$, and charges the data lines $DL_1$–$DL_M$. The display data or signal is sent to the pixel capacitor 4 connected to one of the scan lines $G_1$–$G_N$ selected then via the switching element 3 connected to that selected scan line.

The above active matrix LCD panel driver section is driven at timings as illustrated in FIG. 4.

As shown in FIG. 4, the drain driver 11 causes the data shift register 9 to transfer one line of data DATA in response to the data transfer clock $C_{PH}$ and outputs the output data of the data shift register 9 to the latch circuit 8. After temporarily latching the data in the latch circuit 8 in response to the latch signal LP, the drain driver 11 supplies the display signal via the driver circuit 7 to the active matrix LCD section.

It is apparent from FIG. 4 that the conventional display driving apparatus therefore keeps transferring display data in the data shift register 9 during each scan period. With regard to relatively large characters or the like constituted by dots in units of n×m dots (n×m dots have a same data value), data for the entire display area (entire pixels of data) should therefore be supplied to the LCD section, requiring a large consumed current. FIG. 5 shows, as one example, the case of n=m=4, i.e., each dot being quadrupled both in height and width. With the display of quadrupled height and width, the entire 16 dots in each of display units A1 to A4 each having the size of 4×4=16 dots have the same display data. For such a large character or the like, data for the entire display area (entire pixels of data) should therefore be supplied to the LCD section, increasing the consumed current.

SUMMARY OF THE INVENTION

Accordingly, it is an object of the present invention to provide a liquid crystal display driving apparatus which does not require the transfer of data for the entire display area (entire pixels of data) even for relatively large characters or the like constituted by dots in units of n×m dots, contributing to reducing the consumed current.

To achieve the above object, a display driving apparatus according to this invention comprises a matrix display panel having switching elements and data written elements, connected to the switching elements, arranged in a matrix form, for receiving data line by line and displaying an image; a data line driver circuit connected via data lines to the switching elements of the matrix display panel and having shift means for receiving data, supplied in serial, while shifting the data, and holding means for holding one line of received data, the data held in the holding means being supplied via the data lines to the matrix display panel; and control means, connected to the data line driver circuit, for inhibiting the shift means from receiving a predetermined number of lines of data after the data line driver circuit outputs one line of data.

DETAILED DESCRIPTION OF THE PREFERRED EMBODIMENT

The present invention will now be described referring to the accompanying drawings.

Figure 1:
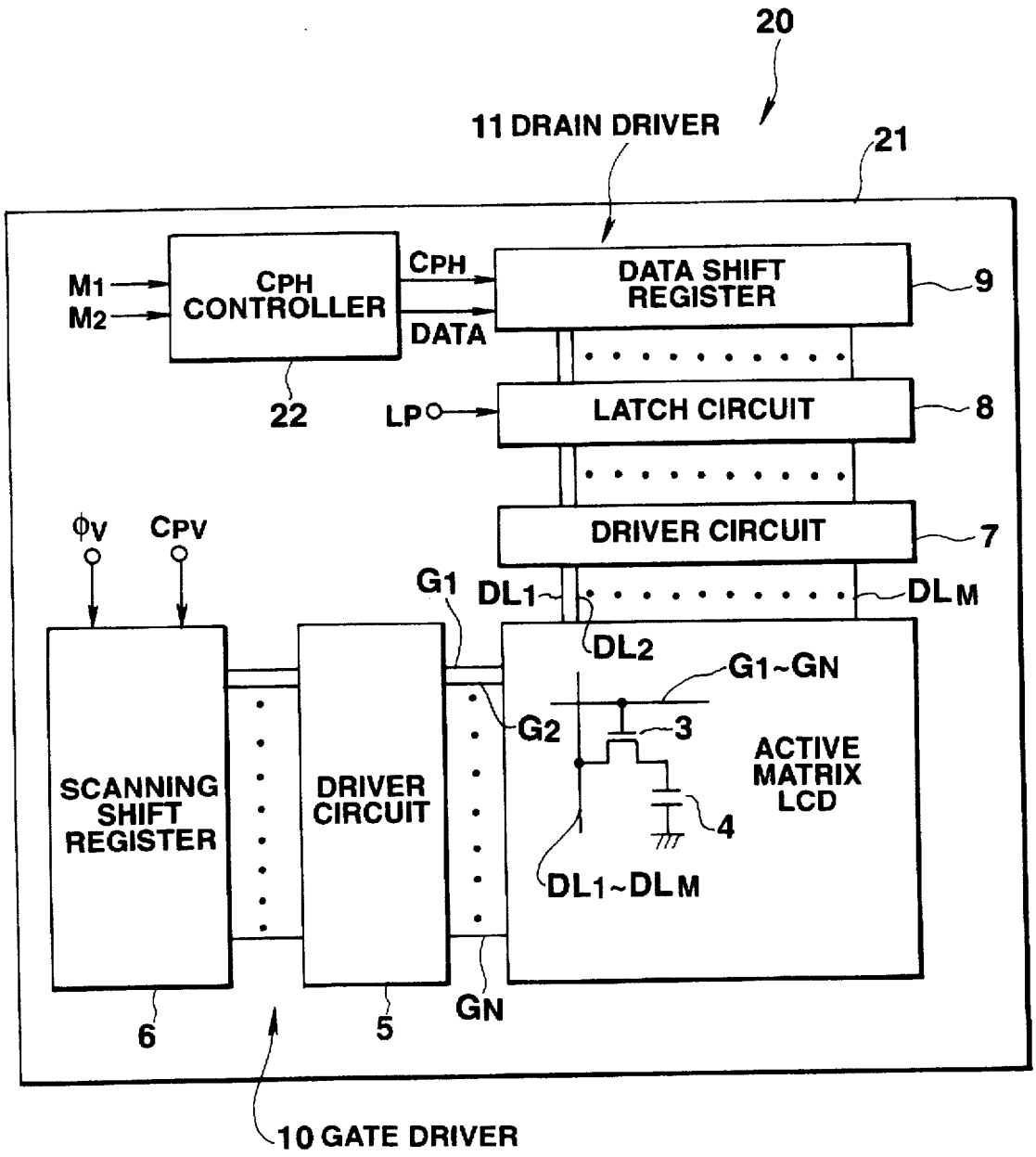
FIG. 1 is a diagram illustrating the circuit structure of a display driving apparatus according to one embodiment of the present invention.
Figure 2:
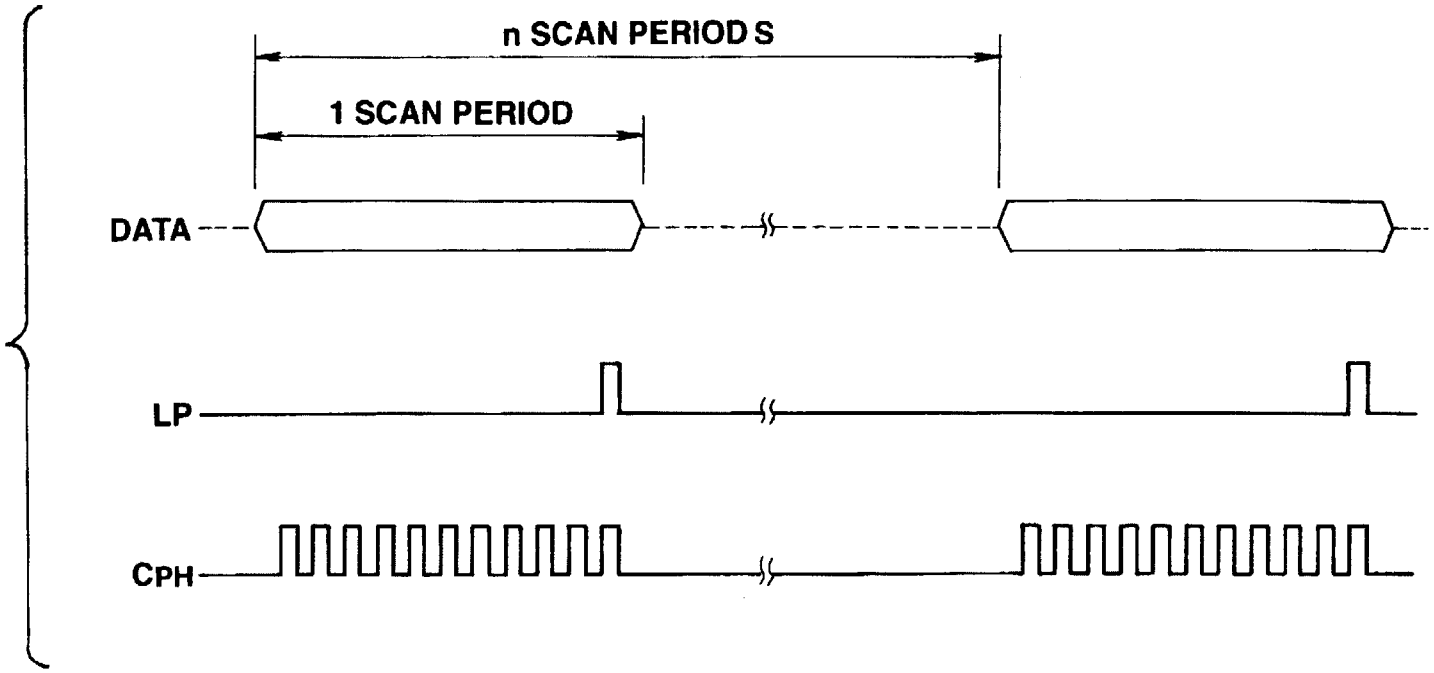
FIG. 2 is a timing chart for the display driving apparatus in FIG. 1 in an intermittent drive mode.

FIGS. 1 and 2 illustrate a liquid crystal display driving apparatus according to one embodiment of the present invention, which uses an active matrix panel.

Figure 3:
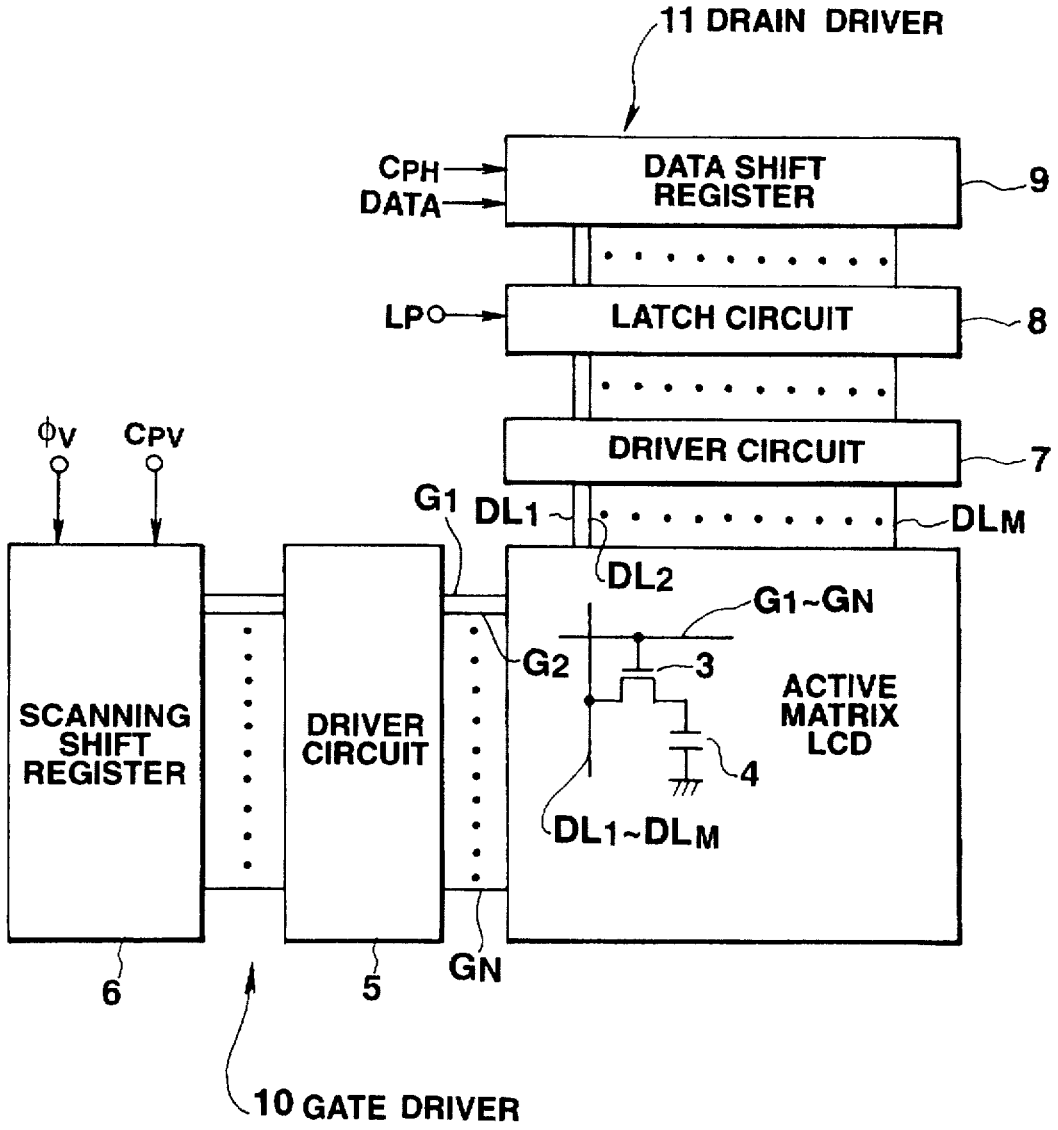
FIG.3 (PRIOR ART)
FIG. 3 is a diagram showing the circuit structure of a conventional liquid crystal display driving apparatus.
Figure 4:
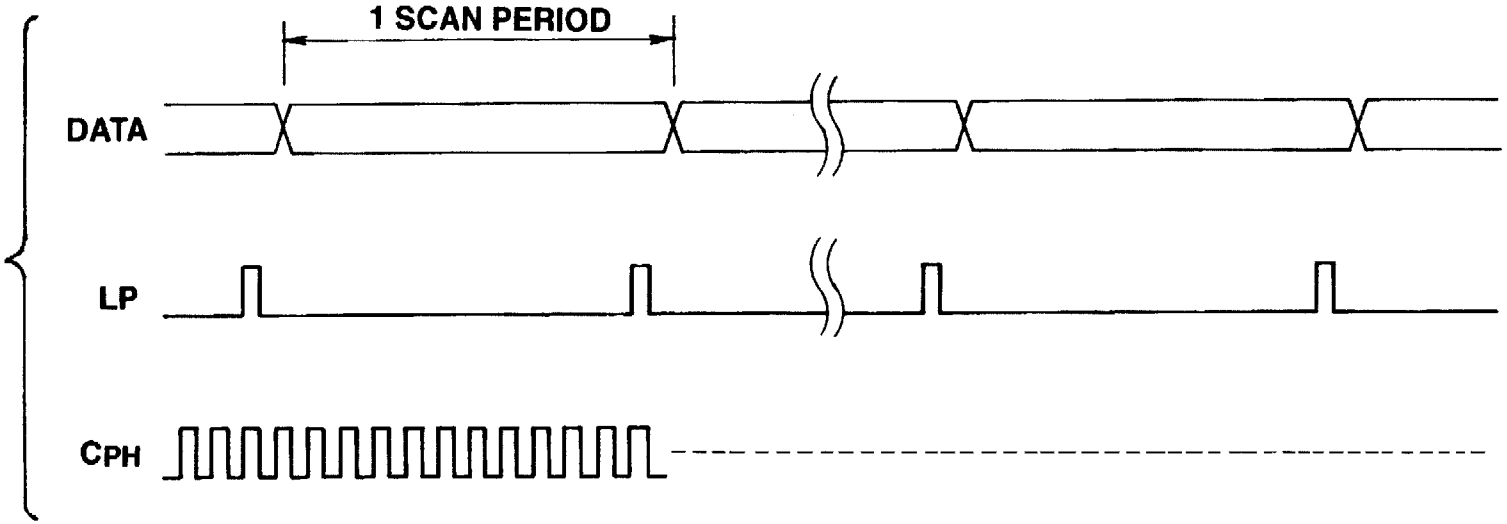
FIG. 4 is a timing chart for the conventional display driving apparatus at the scanning time.

FIG. 1 is a circuit diagram of a liquid crystal display (LCD) driving apparatus 20 embodying this invention.

which uses the same reference numerals and symbols as used for the components of the display driving apparatus shown in FIG. 3 to denote the corresponding or identical components.

Referring to FIG. 1, the LCD driving apparatus 20 has switching elements 3 and pixel capacitors 4 arranged in a matrix form at the intersections of data lines $DL_1$ to $DL_M$ and scan lines $G_1$ to $G_N$, respectively laid out in M columns and N rows. Only one set of the switching element 3 and pixel capacitor 4 Ps illustrated in FIG. 1. The individual scan lines $G_1$–$G_N$ are connected to a scanning shift register 6 via a driver circuit 5 and the individual data lines $DL_1$–$DL_M$ are connected to a data shift register 9 via a driver circuit 7 and a latch circuit 8.

In this active matrix display system, pixel electrodes constituting the pixel capacitors 4 and the switching elements, for example, TFTs (Thin Film Transistors), provided one to one for the respective pixel capacitors 4, are arranged on the inner face of one electrode substrate. The switching elements 3 are driven in a matrix form so that the pixel capacitors 4 are charged via the associated switching elements 3. The driver circuit 5 and the scanning shift register 6 constitute a gate driver 10, while the driver circuit 7, the latch circuit 8 and the data shift register 9 constitute a drain driver 11. Each of the circuits constituting the gate driver 10 and the drain driver 11 is constructed by electrically connecting TFTs formed on a glass substrate 21.

Each TFT 3 has a gate connected to the associated one of the scan lines $G_1$–$G_N$ and a drain connected to the associated one of the data lines $DL_1$–$DL_M$. The source of each TFT 3 is connected to the associated pixel electrode constituting the associated pixel capacitor 4 whose other electrode is connected to a common line (ground).

The scan lines $G_1$–$G_N$ are connected via the driver circuit 5 to the individual output terminals of the scanning shift register 6 formed on the Glass substrate 21. A scan shift clock signal $C_{PV}$ and a scan drive signal $\phi V$ are input to the scanning shift register 6 from a control circuit (not shown). The scanning shift register 6 sequentially sends predetermined scan signals to the respective scan lines $G_1$–$G_N$ in accordance with the scan shift clock signal $C_{PV}$ and the scan drive signal $\phi V$. The driver circuit 5, which is made up of two stages of inverter elements connected in series, is controlled by the unillustrated control circuit.

The individual data lines $DL_1$–$DL_M$ are connected via the driver circuit 7 and latch circuit 8 to the data shift register 9 formed on the Glass substrate 21.

The data shift register 9, which has M serially-connected D flip-flops, receives a data transfer clock $C_{PH}$ and data DATA. The data DATA is sequentially shifted to the individual D flip-flops in the data shift register 9.

A latch signal LP is input to the latch circuit 8 every time one scan line of data DATA is input to the data shift register 9. As the latch signal LP is input to the latch circuit 8, one line of data DATA is latched in the latch circuit 8.

A controller 22 receives a normal mode signal $M_1$ or a double height/width mode signal $M_2$ from the unillustrated control circuit. When the normal mode signal $M_1$ is input to the controller 22, the controller 22 sequentially supplies one scan line of data DATA to the associated one of the scan lines $G_1$–$G_N$ as per the prior art. With the enlarged mode signal $M_2$ input to the controller 22, however, the controller 22 stops outputting the data transfer clock $C_{PH}$ and the data DATA for an (n−1) scan period after outputting one scan line of data. (The details will be given later.) Thereafter, the controller 22 outputs data DATA for the scan line $G_{n+1}$ together with the data transfer clock $C_{PH}$ and stops outputting the data transfer clock $C_{PH}$ and the data DATA for the next (n−1) scan period. Likewise, the controller 22 repeatedly outputs one scan line of data DATA and the data transfer clock $C_{PH}$ and stops outputting the data DATA and the data transfer clock $C_{PH}$ for the (n−1) scan period until it completes the data output to all the scan lines $G_1$–$G_N$. This operation reduces the consumed power of the shift register 9.

The driver circuit 7 amplifies display data, latched in the latch circuit 8, and supplies the amplified data to the data lines $DL_1$–$DL_M$. The display data is supplied to the pixel capacitor 4 connected to a selected one of the scan lines $G_1$–$G_N$ and then via the switching element 3 connected to the selected scan line.

The operation of this embodiment for presenting a double height/width (intermittent drive) display will be discussed below.

FIG. 2 is a timing chart for the drain driver 11 when the enlarge mode signal $M_2$ is supplied to the controller 22.

As shown in FIG. 2, when one scan line of data DATA and the data transfer clock $C_{PH}$ are output from the controller 22, the latch signal LP is supplied to the latch circuit 8 so that the one scan line of data is latched in the latch circuit 8 and is also supplied via the driver circuit 7 to the data lines $DL_1$–$DL_M$. At this time, a gate signal is supplied via the scanning shift register 6 and the driver circuit 5 to the scan line $G_1$, though not illustrated so that the gates of the individual switching elements 3, connected to the scan line $G_1$ and the data lines $DL_1$–$DL_M$, are opened, allowing the data on the data lines $DL_1$–$DL_M$ to be held in the associated pixel capacitors 4.

Thereafter, the controller 22 stops outputting data DATA and the data transfer clock $C_{PH}$ for the (n−1) scan period, and the latch signal LP is not supplied to the latch circuit 8. In other words, the controller 22 does not output the data DATA for the scan lines $G_2$–$G_n$ and the data transfer clock $C_{PH}$. In the case of the quadruple height/width display as exemplified in FIG. 5, after the controller 22 outputs the data DATA for the scan line $G_1$ and the data transfer clock $C_{PH}$, it stops outputting the data DATA and the data transfer clock $C_{PH}$ for the scan lines $G_2$–$G_4$. During this period, the data DATA for the scan line $G_1$ is latched in the latch circuit 8 and is supplied via the driver circuit 7 to the individual data lines $DL_1$–$DL_M$, so that the data DATA for the scan line $G_1$ is accumulated in the pixel capacitors 4 connected to the individual scan lines $G_2$–$G_4$. In the case shown in FIG. 5, the same data for the scan line $G_1$ is supplied to the scan lines $G_2$–$G_4$ and is held there.

Figure 5:
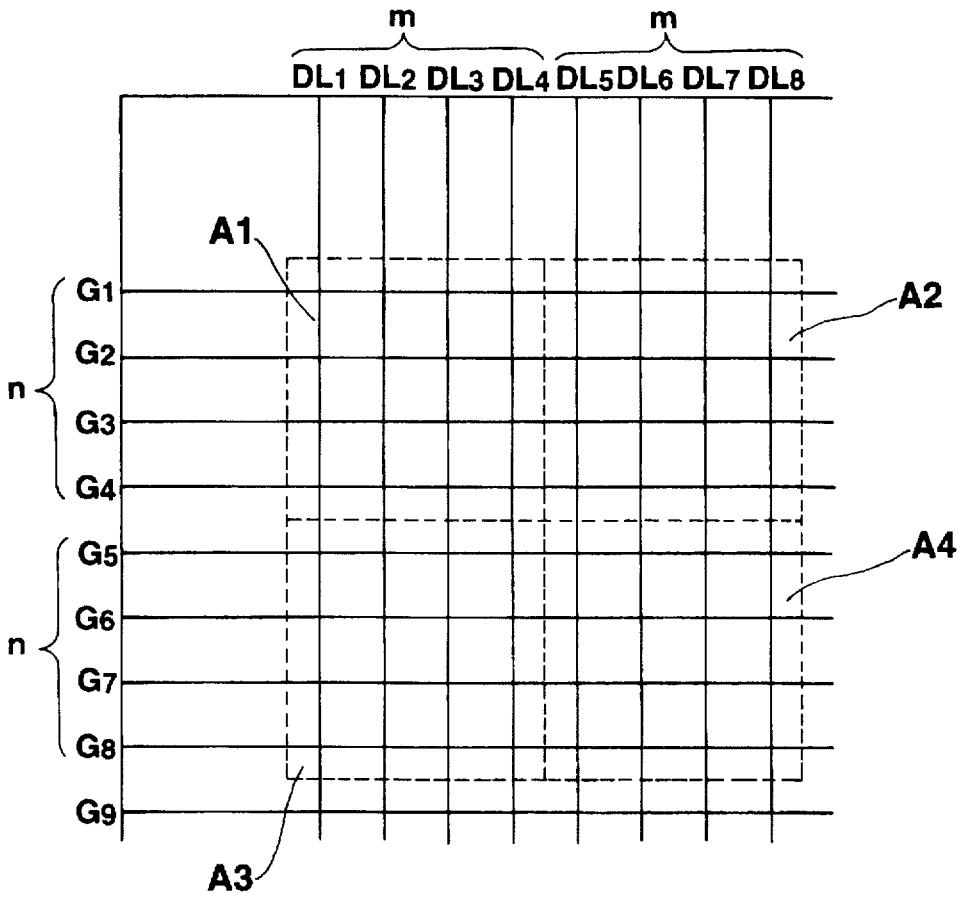
FIG. 5 is a diagram for explaining the display of quadruple height and width.

Then, the data DATA for the scan line $G_{n+1}$ and the data transfer clock $C_{PH}$ are output from the controller 22, and are supplied via the data shift register 9 and the latch circuit 8 to the data lines $DL_1$–$DL_M$. This data DATA is held in the pixel capacitor 4 connected to the scan line $G_{n+1}$. During the next (n−1) scan period too, the outputting of the data DATA and the data transfer clock $C_{PH}$ from the controller 22 is inhibited and the data for the scan line $G_{n+1}$, latched in the latch circuit 8, is held in the pixel capacitors 4 connected to the scan lines $G_{n+1}$–$G_{2n}$. In the example of FIG. 5, the same data for the scan line $G_5$ is supplied to the scan lines $G_6$–$G_8$ and is held there. In the subsequent operation, as already discussed above, the controller 22 repeatedly outputs one scan line of data DATA and the data transfer clock $C_{PH}$ and stops outputting the data DATA and the data transfer clock $C_{PH}$ for the (n−1) scan period, so that for the entire scan lines $G_1$–$G_N$, data is held in the pixel capacitors 4 connected to the individual scan lines.

According to the display driving apparatus embodying this invention, as described above, the number of operations of the data shift register 9 and the latch circuit 8 becomes 1/n as compared to the conventional case, thereby reducing the consumed power accordingly.

Although the embodiment of the present invention described hereinabove relates to an enlarged display as one example, the present invention may be widely adapted for any display driving apparatus which presents the same display on a plurality of scan lines such as a time display. In this case, the numbers of scan lines for the same display need not all be the same. And although the embodiment of the present invention described hereinabove switches between the normal driving that causes the controller to output data and the data transfer clock to all the scan lines and the intermittent driving that stops outputting data and the data transfer clock to predetermined scan lines, the present invention may also be applied to an apparatus which does not execute such switching.

What is claimed is:

1. A display driving apparatus comprising:

(i) a matrix display device for displaying an image, said matrix display device having switching elements and data written elements connected to said switching elements, said switching elements and said data written elements being arranged in rows and columns to form a matrix;

(ii) a plurality of scan lines arranged in a predetermined number of rows, each row of said plurality of scan lines being connected to respective ones of said switching elements arranged along a corresponding row of said matrix;

(iii) a plurality of data lines connected to said switching elements for supplying lines of display data to be displayed on successive rows of said scan lines;

(iv) a data line driver circuit connected to said switching elements via said data lines for supplying said switching elements connected to successive rows of said scan lines with said lines of display data, said data line driver circuit including:

shift means for receiving and shifting lines of display data supplied in serial thereto; and holding means for successively receiving lines of display data from said shift means, holding a previous line of received display data, and supplying the held previous line of display data to said switching elements connected to a successive row of said scan lines when said holding means does not receive a successive new line of display data from said shift means; and (v) control means, connected to said data line driver circuit, for inhibiting said shift means from receiving lines of display data corresponding to a predetermined number of successive rows of said scan lines, wherein said control means includes means for switching between a normal driving mode and an intermittent driving mode before said shift means receives lines of display data, said normal driving mode being a mode in which said shift means successively supplies said lines of display data to said holding means, and said intermittent driving mode being a mode in which said shift means stops supplying said lines of display data to said holding means for a predetermined number of successive rows of said scan lines after said shift means supplies a line of display data to said holding means.

2. The display driving apparatus according to claim 1, wherein said matrix display device comprises a liquid crystal display panel.

3. The display driving apparatus according to claim 1, wherein said switching elements comprise thin film transistors.

4. The display driving apparatus according to claim 1, wherein said data written elements comprise capacitor elements.

5. The display driving apparatus according to claim 1, wherein said matrix display device includes a substrate, and said data line driver circuit is formed on said substrate.

6. The display driving apparatus according to claim 1, wherein said data line driver circuit comprises thin film transistors.

7. The display driving apparatus according to claim 1, further comprising a scan line driver circuit, connected to said switching elements via said scan lines, for sequentially turning on said switching elements.

8. The display driving apparatus according to claim 7, wherein said scan line driver circuit comprises thin film transistors.

9. The display driving apparatus according to claim 1, wherein said holding means includes means for continuously outputting said held previous line of display data for a period corresponding to said predetermined number of successive rows of said scan lines.

10. The display driving apparatus according to claim 1, wherein said control means includes means for inhibiting said shift means from receiving a line of said display data when successive lines of said display data are the same.

11. The display driving apparatus according to claim 1, wherein said control means further includes means for switching to said intermittent driving mode when successive lines of said display data corresponding to said predetermined number of successive rows of said scan lines are the same.

12. A display driving apparatus for driving a matrix display device having a plurality of pixels, comprising:

a scan line driver circuit for supplying a scan signal for switching a line of a predetermined number of said pixels in a horizontal period;

control means including supplying means for supplying display data to a corresponding line of said predetermined number of said pixels, and stopping means for stopping said supplying means from supplying said display data; and a data line driver circuit including a shift register for receiving said display data, line by line, supplied in serial, from said control means, and a latch circuit for receiving said display data from said shift register and holding latch data corresponding to previously received display data, said latch circuit supplying the held latch data to a successive line of said predetermined number of said pixels only when said latch circuit does not receive corresponding successive display data from said shift register.

13. The display driving apparatus according to claim 12, wherein said stopping means includes means for stopping said supplying means from supplying said display data to said shift register when said display data is coincident with previous display data supplied to said shift register.

14. The display driving apparatus according to claim 12, wherein said latch circuit includes means for continuously outputting said held latch data every horizontal period to successive lines of said predetermined number of said pixels when said latch circuit does not receive corresponding successive display data from said shift register.

15. The display driving apparatus according to claim 12, wherein said control means includes operation-stopping means for stopping a shift operation of said shift register when said stopping means stops supplying said display data to said shift register.

16. The display driving apparatus according to claim 12, wherein said display driving apparatus comprises a liquid crystal display device.

17. The display driving apparatus according to claim 12, wherein said display driving apparatus comprises a liquid crystal display device having said plurality of pixels, and said pixels comprise liquid pixel capacitors.

18. The display driving apparatus according to claim 12, wherein said display driving apparatus comprises a liquid crystal display device having said plurality of pixels, and said pixels comprise picture electrodes and thin film transistors connected to said picture electrodes.

19. The display driving apparatus according to claim 12, wherein said display driving apparatus comprises a liquid crystal display device having a substrate on which at least one of said scan line driver circuit, said control means, and said data line driver circuit are formed.

20. The display driving apparatus according to claim 12, wherein said control means includes means for switching between a normal driving mode in which said shift register supplies one line of display data to said latch circuit when said shift register receives one line of display data, and an intermittent driving mode in which said shift register stops supplying said latch circuit with display data for a period corresponding to a predetermined number of successive lines after said latch circuit supplies the held latch data to a line of said predetermined number of said pixels.

* * * * *